US010422255B2

(12) United States Patent
Biermann et al.

(10) Patent No.: US 10,422,255 B2
(45) Date of Patent: Sep. 24, 2019

(54) HYDRAULIC SUPPORT ELEMENT WITH A RING FILTER

(71) Applicant: Schaeffler Technologies AG & Co. KG, Herzogenaurach (DE)

(72) Inventors: Andreas Biermann, Furth (DE); Matthias Ammann, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/992,739

(22) Filed: May 30, 2018

(65) Prior Publication Data

US 2018/0355768 A1 Dec. 13, 2018

(30) Foreign Application Priority Data

Jun. 8, 2017 (DE) ..... 10 2017 112 574

(51) Int. Cl.
*F01L 1/46* (2006.01)
*F01L 1/245* (2006.01)
(Continued)

(52) U.S. Cl.
CPC ..... *F01L 1/46* (2013.01); *F01L 1/143* (2013.01); *F01L 1/146* (2013.01); *F01L 1/185* (2013.01);
(Continued)

(58) Field of Classification Search
CPC . F01L 1/143; F01L 1/146; F01L 1/185; F01L 1/24; F01L 1/245; F01L 1/2405;
(Continued)

(56) References Cited

U.S. PATENT DOCUMENTS 3,267,918 A * 8/1966 Ayres ..... F01L 1/245 123/90.35
8,161,925 B2 * 4/2012 Schnell ..... C23C 14/0605 123/90.16
(Continued)

FOREIGN PATENT DOCUMENTS

DE 10330510 1/2005
DE 102004033500 2/2006
(Continued)

*Primary Examiner* — Grant Moubry
(74) *Attorney, Agent, or Firm* — Volpe and Koenig, P.C.

(57) ABSTRACT

A hydraulic support element for a variable valve train of an internal combustion engine, which has a cylindrical pot-shaped housing and a hollow cylindrical piston guided for movement in this housing and whose inner end is supported by a compression spring on the base wall of the housing. The outer end extends past the housing and is formed as a hemispherical bearing head. The interior is divided into an inner supply pressure space and an outer switching pressure space that are connected by inlet openings in the cylindrical side walls of the housing and the piston with a cylinder head side supply pressure line and by a non-return valve to a high-pressure space enclosed between the inner end of the piston and the base wall of the housing, or to a cylinder head side switching pressure line and also by a central hole formed in the bearing head to a rocker arm side switching pressure channel. To prevent the entry of harmful particles into the supply pressure space and/or the switching pressure space of the piston, the piston has a ring-shaped recess in its cylindrical side wall in the area of the inlet openings on the outside in the radial direction, and a filter element constructed as a ring filter is inserted into the ring-shaped recess of the piston with an axial positive-fit connection.

18 Claims, 4 Drawing Sheets

(51) Int. Cl.
*F01L 1/14* (2006.01)
*F01L 1/18* (2006.01)
*F01L 1/24* (2006.01)

(52) U.S. Cl.
CPC ..... *F01L 1/24* (2013.01); *F01L 1/2405* (2013.01); *F01L 1/245* (2013.01); *F01L 2001/186* (2013.01); *F01L 2101/00* (2013.01); *F01L 2103/00* (2013.01); *F01L 2810/05* (2013.01)

(58) Field of Classification Search
CPC ... F01L 1/46; F01L 2001/186; F01L 2101/00; F01L 2103/00; F01L 2810/05
See application file for complete search history.

(56) References Cited

U.S. PATENT DOCUMENTS

| | | | | |
|---|---|---|---|---|
| 2007/0272192 | A1 | 11/2007 | Sailer et al. | |
| 2008/0115751 | A1* | 5/2008 | Knecht | F01L 1/34 123/90.17 |
| 2010/0294220 | A1* | 11/2010 | Ferreri | F01L 9/023 123/90.11 |
| 2010/0300388 | A1* | 12/2010 | Lang | F01L 1/3442 123/90.17 |

FOREIGN PATENT DOCUMENTS

| | | |
|---|---|---|
| FR | 2910529 | 6/2008 |
| RU | 2231650 | 6/2004 |

* cited by examiner

HYDRAULIC SUPPORT ELEMENT WITH A RING FILTER

INCORPORATION BY REFERENCE

The following documents are incorporated herein by reference as if fully set forth: German Patent Application No. 10 2017 112 574.4, filed Jun. 8, 2017.

BACKGROUND

The invention relates to a hydraulic support element for a variable valve train of an internal combustion engine, which comprises a cylindrical pot-shaped housing and a hollow cylindrical piston that is guided so that it can move axially in this housing and whose inner end is supported by a compression spring on the base wall of the housing, whose outer end tops the outer edge of the housing and is constructed as a hemispherical bearing head, and whose interior is divided into an inner supply pressure space and an outer switching pressure space, wherein the supply pressure space can be connected by inlet openings in the cylindrical side walls of the housing and the piston to a cylinder head side supply pressure line and can be connected by a non-return valve to a high-pressure space surrounded between the inner end of the piston and the base wall of the housing, and in which the switching pressure space can be connected by inlet openings in the cylindrical side walls of the housing and the piston with a cylinder head side switching pressure line and by a central hole formed in the bearing head to a rocker arm side switching pressure channel.

Hydraulic support elements are used in valve trains of internal combustion engines in which the gas exchange valves, such as intake and outlet valves, are actuated by the cam of a camshaft by rocker arms. The rocker arms are connected at one end to the outer end of the valve shaft of at least one gas exchange valve and are supported on the cylinder head so that they can pivot at the other end on the same side by means of a hydraulic support element. Between its two ends, the rocker arms each contact at least one cam of a camshaft on the side facing away from the gas exchange valve and the support element. When the camshaft rotates, the rocker arms are pivoted according to the stroke contour of the cam about the bearing on the corresponding support element in the direction toward the gas exchange valve or under the effect of the valve springs in the opposite direction, whereby the relevant gas exchange valves are opened or closed.

In the hydraulic support elements there is an integrated device for the automatic equalization of a possibly present valve lash between the allocated cams of the camshaft and the valve shaft of the allocated gas exchange valve. When the support element is loaded, its piston is pressed axially into the housing of the support element, whereby a high pressure is established in the high-pressure space, by which the non-return valve is held closed and a rigid connection between the piston and the housing is formed in connection with the incompressible engine oil located in the high-pressure space. When the load is removed from the support element, its piston is pressed by the compression spring axially out of the housing and in this way an empty clearance in the valve train is compensated. Here, in the high-pressure space, a vacuum pressure is set, by which the non-return valve is opened, so that engine oil can flow out of the supply pressure space into the high-pressure space for equalizing leakage losses.

In the installed state, each support element is typically inserted into an essentially vertically aligned supporting hole of a cylinder head of the internal combustion engine. A supply pressure line of a supply oil gallery opens axially on the inside into the respective supporting hole. The supply storage space of the piston is thus in connection with this cylinder head side supply pressure line via the axially inner inlet openings in the cylindrical side walls of the housing and the piston, so that engine oil escaping from the high-pressure space due to leakage can be replaced from the supply pressure space.

In the present case, the internal combustion engine has a variable valve train in which valve strokes can be shut down or shifted by hydraulically switchable rocker arms. For transferring the engine oil that acts as a switching oil and is alternately essentially not pressurized or under a high switching pressure depending on the current switching state, a switching pressure line of a switching oil gallery opens axially farther outside in the respective supporting hole. The switching pressure space of the piston is thus connected on one side via the axial outer inlet openings in the cylindrical side walls of the piston and the housing to this cylinder head side switching pressure line and on the other side via a central bore in the bearing head of the piston to a switching pressure channel arranged in the associated rocker arm. Because the engine oil located in the supply pressure space and the engine oil located in the switching pressure space of a hydraulic support element fulfill different functions and can have different pressure values, these pressure spaces located within the interior of the piston are usually separated from each other by a partition element. A known construction of a dual-flow hydraulic support element is described, for example, in DE 103 30 510 A1.

Typically, both the supply oil gallery and also the switching oil gallery are connected to an oil supply system of the internal combustion engine, in which there is also at least one filter element for separating harmful particles, such as oil carbon particles due to combustion as well as metal particles due to work and wear. Nevertheless, harmful particles can still enter the hydraulic support elements via the supply oil gallery and the switching oil gallery, whereby both the function of the valve lash compensation in the support elements and also the switching function in the rocker arms can be negatively affected. This relates especially to the initial commissioning of the internal combustion engine after its assembly, in which particles that have not been removed from the mechanical work on the cylinder head can enter the hydraulic support elements via the supply oil gallery and the switching oil gallery and also from these elements into the switchable rocker arms. For preventing the associated disadvantages, hydraulic support elements with installed filter elements have already been proposed.

From RU 2 231 650 C2, a single-flow hydraulic support element for a non-switchable valve train of an internal combustion engine is known, in which a filter element is arranged within the piston between two diagonally opposite inlet openings arranged in the cylindrical side wall of the piston and the non-return valve. The filter element is formed of a coupling-like arched filter screen and a ring-shaped edge connector and is fixed axially in the piston by fastening element inserted into the inlet opening. Due to its ends extending from the inlet openings of the piston and engaging in an inner ring-shaped recess in the cylindrical side wall of the housing, the fastening element of the filter element is also effective as transport protection. The assembly of the filter element within the piston, however, is relatively complicated.

In FR 2 910 529 A3, a single-flow hydraulic support element for a non-switchable valve train of an internal combustion engine is described, in which a filter element constructed as a ring filter is arranged in a first arrangement in an outer ring-shaped recess and in a second arrangement on an inner ring-shaped section in the cylindrical side wall of the housing. The ring-shaped recess and the ring-shaped section are constructed in the cylindrical side wall of the housing such that the ring filter covers the respective inlet openings of the housing. The ring filter has a closed construction on the circumferential side and consists of a cylindrical filter screen and two ring-shaped edge connectors, whereby for the assembly of the filter element, strong elongation of the ring filter is required at least in the first arrangement.

In FIG. 2, DE 10 2014 033 500 A1 shows a tappet for loading a tappet rod with an oil supply via the latter "from above." In the supply space of its pressure piston, a filter cap is attached to a bottom side of a contact for the tappet rod.

SUMMARY

In view of the disadvantages of the known constructions and arrangements of a filter element in a hydraulic support element, the invention is based on the problem of providing a hydraulic support element for a variable valve train of an internal combustion engine of the type named above, which is provided with at least one filter element with a favorable construction and arrangement.

This is achieved by a hydraulic support element for a variable valve train of an internal combustion engine with one or more features of the invention. Advantageous refinements are explained below and in the claims.

Accordingly, the starting point is a hydraulic support element for a variable valve train of an internal combustion engine, which has a cylindrical pot-shaped housing and a hollow cylindrical piston that is guided so that it can move axially in this housing and whose inner end is supported by a compression spring on the base wall of the housing, whose outer end extends past the outer edge of the housing and is formed as a hemispherical bearing head, and whose interior is divided into an inner supply pressure space and an outer switching pressure space, wherein the supply pressure space is connected by inlet openings in the cylindrical side walls of the housing and the piston with a cylinder head side supply pressure line and also can be connected by a non-return valve to a high-pressure space enclosed between the inner end of the piston and the base wall of the housing, and in which the switching pressure space is connected by inlet openings in the cylindrical side walls of the housing and the piston to a cylinder head side switching pressure line and also by a central hole formed in the bearing head to a rocker arm side switching pressure channel.

To prevent the entry of harmful particles into the supply pressure space and/or the switching pressure space of the piston, it is provided that the piston has a ring-shaped recess in its cylindrical side wall in the area of the inlet openings leading into the supply pressure space and/or into the switching pressure space on the outside in the radial direction, and that a filter element constructed as a circumferential side open ring filter is inserted into the ring-shaped recess of the piston with an axial positive-fit connection.

The particles introduced with the supplied engine oil via the supply pressure line and/or the switching pressure line are thus held back at the ring filter before entry into the piston of the support element, whereby the function of the valve lash compensation in the support element and the switching function in the associated rocker arm are guaranteed. Due to the circumferential side open construction of the ring filter, its assembly on the piston is simplified, because the required elastic widening of the ring filter is possible with low expenditure of force and without the risk of damage due to over-extension. Due to the axial fixing and the arrangement on the piston, the ring filter is protected both before installation of the support element in the cylinder head of the internal combustion engine and also in the installed state of the support element during operation of the engine.

According to one advantageous refinement, it is provided that the ring filter has a circumferential side open cylindrical filter screen and a filter frame surrounding the filter screen, and that the filter frame has two circumferential side open ring-shaped edge connectors arranged on the axial outer edges of the filter screen, two straight edge connectors arranged on the circumferential side ends of the filter screen between the ring-shaped edge connectors, and several support connectors arranged between the ring-shaped edge connectors distributed on the circumferential side within the filter screen. Due to this construction of the filter frame, the ring filter has a high stability, and the filter screen is well protected from damage that could lead to the introduction of particles into the supply pressure space and/or the switching pressure space of the piston.

In order to guarantee a circumferential side closed filter contour of the ring filter in the assembled state, it is preferably provided that the straight edge connectors of the filter frame lie one above the other so that they can move with a sliding motion on the circumferential side due to an essentially flat radial outer recess on the radial inner edge connector and also an essentially flat radial inner recess on the radial outer edge connector in the assembled state. In addition, a positive-fit locking connection of the straight edge connectors of the ring filter is also possible.

If the number of relevant inlet openings in the cylindrical side wall of the piston is an even number, that is, e.g., two, the sum of the straight connectors acting as a common connector and counted as a single connector as well as the support connectors of the filter frame should be an odd number, in order to prevent that after the assembly of the ring filter on the piston, an edge or support connector is located randomly in front of each of the inlet openings of the piston, whereby the supply of engine oil into the supply pressure space and/or into the switching pressure space would be strongly impaired.

To simplify the assembly and to prevent damage to the ring filter due to widening during assembly, it is preferably provided that the ring-shaped edge connectors of the filter frame are each provided with essentially identical radial outer recesses that are arranged diagonally opposite the circumferential side separating gap of the ring filter. Due to the recesses, the bending stiffness of the ring-shaped edge connectors of the filter frame, it is significantly reduced there, so that this area of the filter frame functions as a bending hinge, about which the halves of the ring filter are folded for the widening required during assembly.

Because the ring filter is inserted into the outer ring-shaped recess in the cylindrical side wall of the piston with an axial positive-fit connection, due to a corresponding construction of the filter frame in the not-installed state of the support element, the piston can also be prevented from falling out of the housing and thus a polygonal ring made from wire and typically used as transport protection can be eliminated. For this purpose it is preferably provided that on the axial inner ring-shaped edge connector or on the axial outer ring-shaped edge connector of the filter frame, several projections extending outward in the radial direction are arranged distributed on the circumferential side, with these projections contacting an axial outer edge of an inner ring-shaped recess in the cylindrical side wall of the housing for an outward axial displacement of the piston.

The radial projections can be constructed as circular segment-shaped bulges of the ring-shaped edge connector arranged between the straight edge connectors and the support connectors of the filter frame.

As an alternative to this arrangement, however, the radial projections can also be constructed as support connectors formed integrally on the relevant ring-shaped edge connector adjacent to the outer straight edge connector or one of the support connectors of the filter frame.

With respect to the construction and the production of the ring filter, it can be provided that the filter screen and the filter frame of the ring filter are produced integrally as injection molded parts from a suitable plastic.

As an alternative to this arrangement, however, it is also possible that the filter screen of the ring filter is made from a wire or fiber mesh and that the filter screen is injection molded with a suitable plastic for forming the filter frame in an injection molding process.

It can be easily understood with the knowledge of the invention that the construction and arrangement of a filter element according to the invention can also be used for a single-flow hydraulic support element for a non-switchable valve train of an internal combustion engine.

BRIEF DESCRIPTION OF THE DRAWINGS

Drawings with two embodiments are provided for further illustrating the invention. Shown in the drawings are.

DETAILED DESCRIPTION

Below, the construction and arrangement of a filter element 30, 30' according to the invention is explained using a dual-flow hydraulic support element 2 for a variable valve train of an internal combustion engine in two embodiments. Because the structure and the function of a dual-flow hydraulic support element is known, for example, from DE 103 30 510 A1, the figures and their description are limited to the construction and arrangement of the respective filter element 30, 30'.

Figure 1:
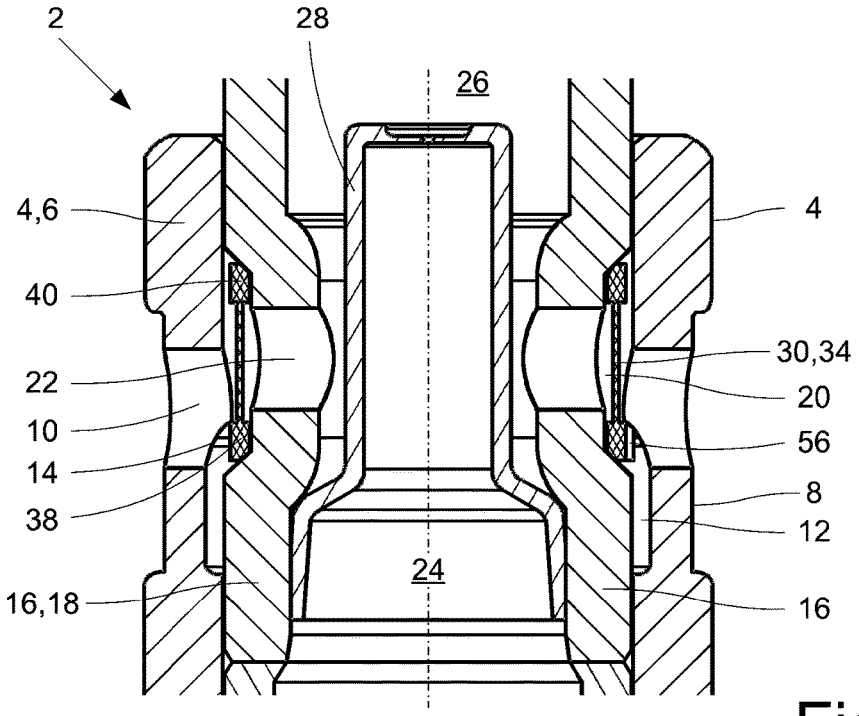
FIG. 1 a section of a hydraulic support element according to a first embodiment of a filter element in a longitudinal center section, FIG. 1A a section of the piston of the support element according to FIG. 1 according to the first embodiment of the filter element in a perspective view, FIG. 1B the filter element according to FIGS. 1 and 1*a* in a first perspective view, FIG. 1C the filter element according to FIGS. 1 and 1*a* in a second perspective view, FIG. 2 a section of a hydraulic support element according to a second embodiment of a filter element in a longitudinal center section, FIG. 2A a section of a piston of the support element according to FIG. 2 according to the second embodiment of the filter element in a perspective view, FIG. 2B the filter element according to FIGS. 2 and 2*a* in a first perspective view, and FIG. 2C the filter element according to FIGS. 2 and 2*a* in a second perspective view.

In FIG. 1, an axial section of a dual-flow hydraulic support element 2 is shown as a longitudinal center section, with this element having a cylindrical pot-shaped housing 4 and a hollow cylindrical piston 16 guided so that it can move axially within this housing. In the cylindrical side wall 6 of the housing 4, an outer ring-shaped recess 8 is formed on the outside in the radial direction, in which two diagonally opposite inlet openings 10 are arranged. In the cylindrical side wall 18 of the piston 16 there is likewise an outer ring-shaped recess 20 on the outside in the radial direction, in which two diagonally opposite inlet openings 22 are arranged. The ring-shaped recesses 8, 20 and the inlet openings 10, 22 in the cylindrical side walls 6, 18 of the housing 4 and the piston 16 are used in the installed state of the support element 2 in a supporting hole of a cylinder head for supplying engine oil from a cylinder head side switching pressure line into a switching pressure space 26 arranged in the interior of the piston 16 on the outside in the axial direction. The switching pressure space 26 is separated by a cylindrical pot-shaped partition element 28 from a supply pressure space 24 arranged in the interior of the piston 16 on the inside in the axial direction.

In the outer ring-shaped recess 20 of the piston 16, a filter element 30 constructed as an open ring filter on the circumferential side is inserted with an axial positive-fit connection. The particles introduced via the cylinder head side switching pressure line with the supplied engine oil are thus held back at the ring filter 30 before entry into the switching pressure space 26, whereby the switching function in the associated rocker arm is guaranteed. Due to the circumferential side open construction of the filter element 30, its assembly on the piston 16 is possible by an elastic widening of the ring filter 30 in a simple way and without the risk of damage to the ring filter 30.

Figure 1A:
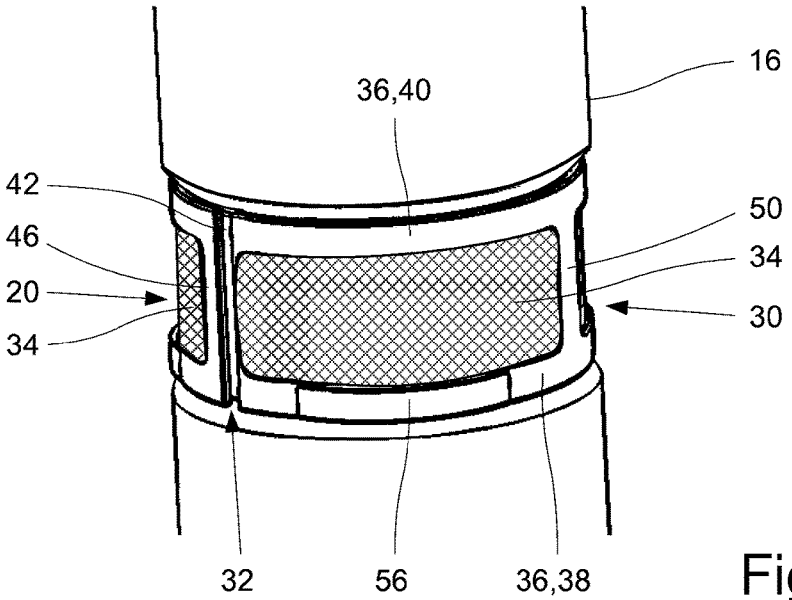
Figure 1B:
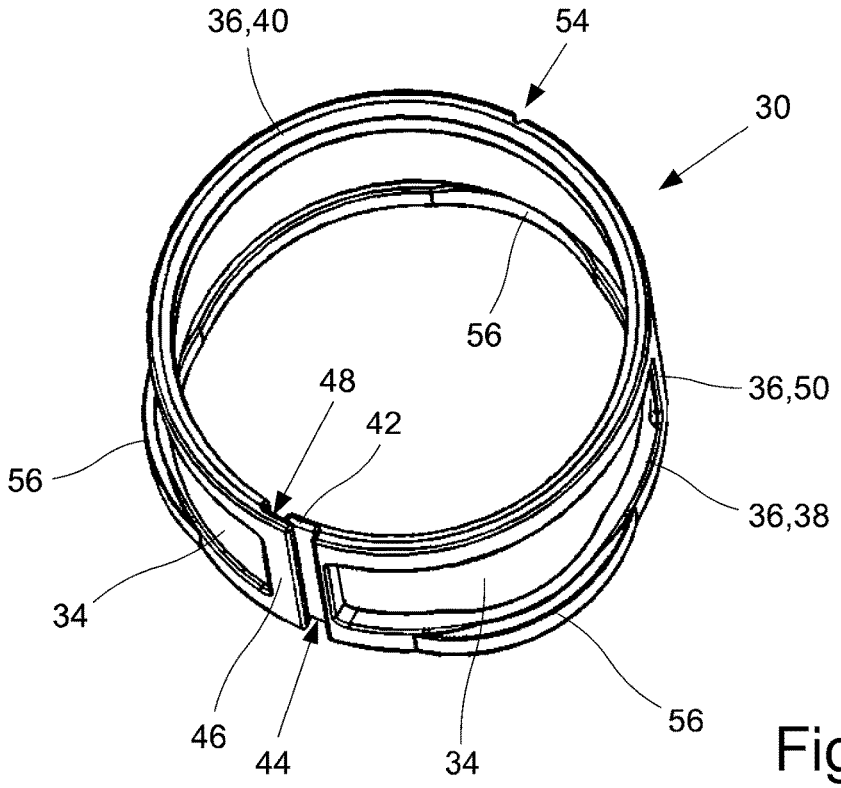
Figure 1C:
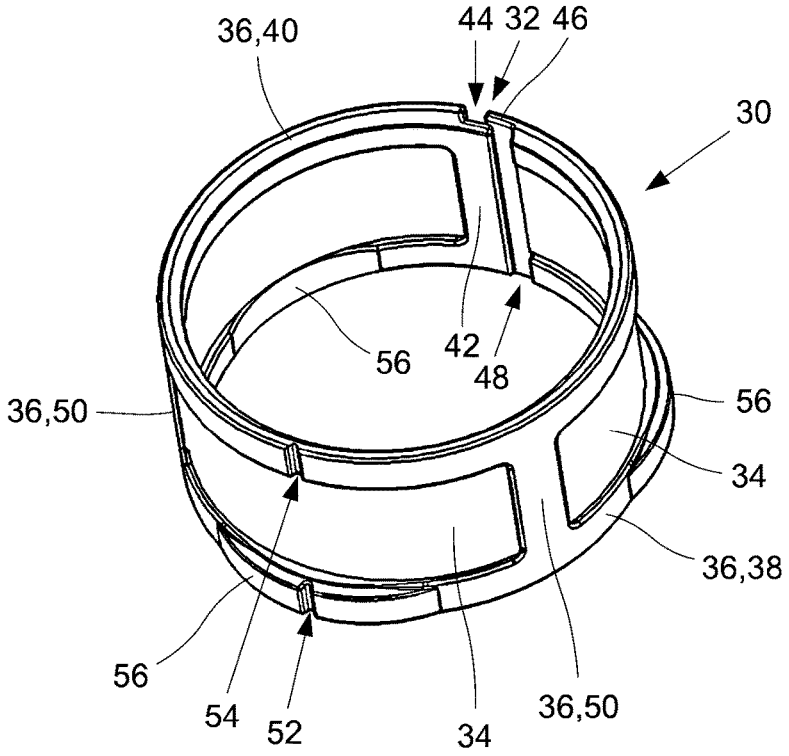

In the perspective view of FIG. 1A, which shows a section of the piston 16 with the assembled ring filter 30, as well as in the perspective views of the ring filter 30 in FIGS. 1B and 1C, the structure of the ring filter 30 can be seen in more detail. Accordingly, the ring filter 30 has a cylindrical filter screen 34 that is open on the circumferential side and a filter frame 36 surrounding the filter screen 34. The filter frame 36 comprises two ring-shaped edge connectors 38, 40 that are arranged on the axial outer edges of the filter screen 34 and are open on the circumferential side, two straight edge connectors 42, 46 that are arranged on the circumferential side ends of the filter screen 34 between the ring-shaped edge connectors 38, 40, and multiple support connectors 50 arranged between the ring-shaped edge connectors 38, 40 distributed on the circumferential side within the filter screen 34.

The radial inner straight edge connector 42 is provided with an essentially flat radial outer recess 44 and the radial outer straight edge connector 46 with an essentially flat radial inner recess 48, so that the straight edge connectors 42, 46 of the filter frame 36 lie one above the other so that they can move in a sliding motion on the circumferential side in the installed state. With the straight edge connectors 42, 46 acting as a common connector and counted as a single connector, as well as the two support connectors 50 of the filter frame 36, the total number of axial connectors is three, whereby it is prevented that after the assembly of the ring filter 30 on the piston 16, an edge connector 42, 46 or support connector 50 is located randomly in front of each of the two inlet opening 22 of the piston 16, whereby the supply of engine oil from the cylinder head side switching pressure line into the switching pressure space 26 would be strongly negatively affected.

The ring-shaped edge connectors 38, 40 of the filter frame 36 are each provided with an essentially identical radial outer recess 52, 54 that are arranged diagonally opposite the circumferential-side partition gap 32 of the ring filter 30. Due to the two recesses 52, 54, the bending stiffness of the ring-shaped edge connectors 38, 40 of the filter frame 36 is significantly reduced there, so that this area of the filter frame 36 functions as a bending hinge, about which the halves of the ring filter 30 are folded during widening movements due to installation.

On the axial inner ring-shaped edge connector 38 of the filter frame 36 there are projections 56 that extend outward in the radial direction and are distributed on the circumferential side and contact an axial outer edge 14 of a radial inner ring-shaped recess 12 in the cylindrical side wall 6 of the housing 4 for an axial displacement of the piston 8 outward in the axial direction. Due to these projections 56 on the filter frame 36 of the ring filter 30, in the not installed state of the support element 2, the piston 16 is prevented from falling out of the housing 4 and thus a polygonal ring made from wire that is typically used as transport protection can be eliminated.

In the first embodiment of the ring filter 30 shown in FIGS. 1 and 1A to 1C, the radial projections 56 are constructed as circular segment-shaped bulges of the inner ring-shaped edge connector 38, which are arranged between the straight edge connectors 42, 64 and the support connectors 50 of the filter frame 36. Due to the arrangement of the bulges 56, the radial outer recess 52 is located in the axial inner ring-shaped edge connector 38 essentially centrally within the relevant bulge 56. In FIG. 1, the support element 2 is shown in the unloaded state, in which the piston 16 is located due to the contact of the bulges 56 of the filter frame 36 on the axial outer edge 14 of the inner ring-shaped recess 12 of the housing 4 in the corresponding stop position.

Figure 2:
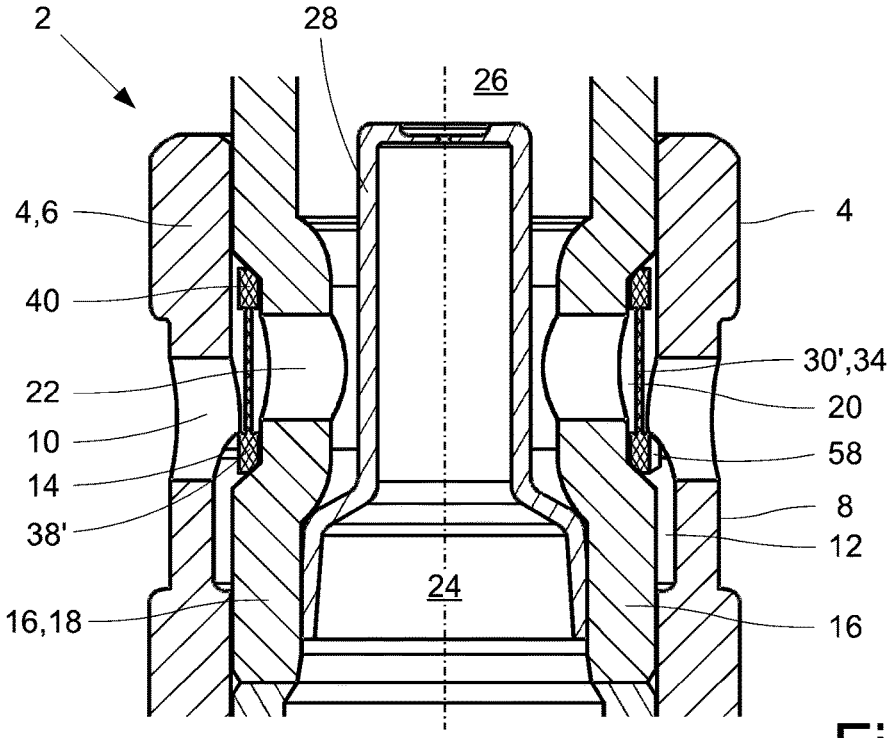
Figure 2A:
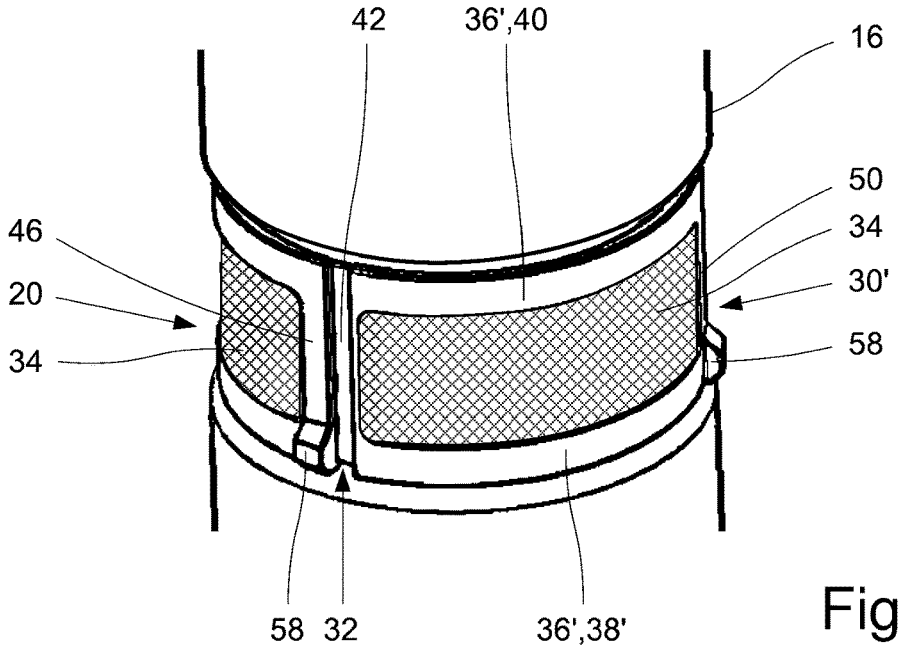
Figure 2B:
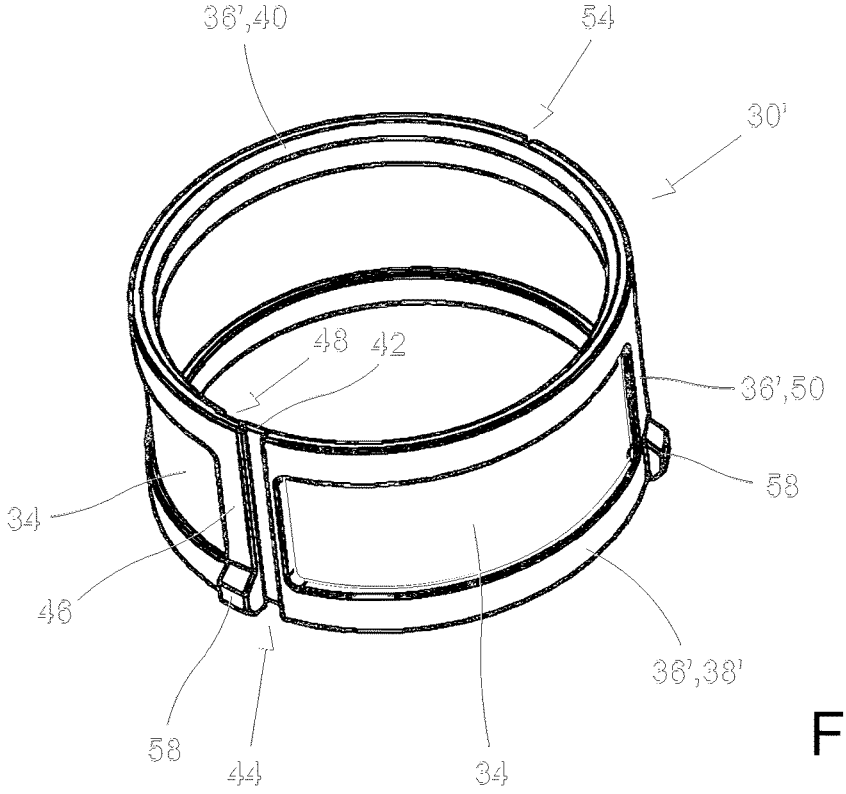
Figure 2C:
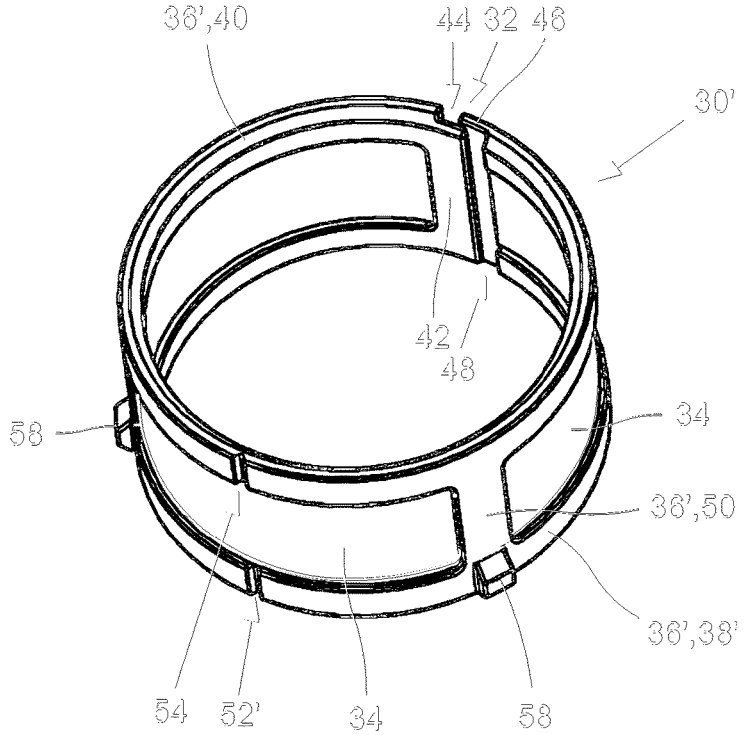

In FIGS. 2 and 2A to 2C, the same hydraulic support element 2 is shown with a second embodiment of the ring filter 30', in which the radial projections are constructed a connector tabs 58 formed integrally on the inner ring-shaped edge connector 38'. For reasons of stability, the connector tabs 58 are each arranged axially adjacent to the outer straight edge connector 46 or one of the support connectors 50 of the filter frame 36' on the inner ring-shaped edge connector 38'. Due to the arrangement of the connector tabs 58, the radial outer recess 52' is located in the axial inner ring-shaped edge connector 38' essentially centrally between two connector tabs 58. In FIG. 2, the support element 2 is also shown in the unloaded state, in which the piston 16 is located by the contact of the connector tabs 58 of the filter frame 36' on the axially outer edge 14 of the inner ring-shaped recess 12 of the housing 4 in the corresponding stop position.

The filter screen 34 and the filter frame 36, 36' of the ring filter 30, 30' can be produced integrally from a suitable plastic as an injection molded part. However, it is also possible that the filter screen 34 of the ring filter 30, 30' is made from a wire or fiber mesh, and that a suitable plastic is molded around the filter screen 34 for forming the filter frame 36, 36' in an injection molding process.

LIST OF REFERENCE SYMBOLS

2 Hydraulic support element
4 Housing
6 Side wall
8 Outer ring-shaped recess
10 Inlet opening
12 Inner ring-shaped recess
14 Outer edge
16 Piston
18 Side wall
20 Outer ring-shaped recess
22 Inlet opening
24 Supply pressure space
26 Switching pressure space
28 Partition element
30, 30' Filter element, ring filter
32 Separating gap
34 Filter screen
36, 36' Filter frame
38, 38' Inner ring-shaped edge connector
40 Outer ring-shaped edge connector
42 Inner straight edge connector
44 Outer recess
46 Outer straight edge connector
48 Inner recess
50 Support connector
52, 52' Recess
54 Recess
56 Radial projection; bulge
58 Radial projection; connector tab

The invention claimed is:

1. A hydraulic support element for a variable valve train of an internal combustion engine, the hydraulic support element comprising:

a cylindrical pot-shaped housing having a cylindrical side wall and a base wall;

a hollow cylindrical piston guided for axial movement in said housing, the hollow cylindrical piston having a cylindrical side wall, an inner end and an outer end, the outer end extends past an outer edge of the housing and is constructed as a hemispherical bearing head;

an interior of the hollow cylindrical piston is divided into an inner supply pressure space and an outer switching pressure space, the supply pressure space is connectable via inlet openings in the cylindrical side wall of the housing and the cylindrical side wall of the piston with a supply pressure line on a cylinder head side and is connectable via a non-return valve to a high pressure space enclosed between the inner end of the piston and the base wall of the housing, and the switching pressure space is connectable via inlet openings in the cylindrical side wall of the housing and the cylindrical side wall of the piston with a cylinder head side switching pressure line and also by via a central hole formed in the bearing head with a rocker arm side switching pressure channel, the piston has, in the cylindrical side wall in an area of the inlet openings leading into at least one of the supply pressure space or the switching pressure space, a ring-shaped recess radially on an outside thereof;

a compression spring that acts on the inner end of the hollow cylindrical piston and is supported on the base wall of the housing; and, a filter element constructed as a ring filter that is open on a circumferential side is inserted axially with a positive fit connection into the ring-shaped recess of the piston.

2. The support element according to claim 1, wherein the ring filter comprises:

a cylindrical filter screen that is open on a circumferential side;

a filter frame surrounding the filter screen, the filter frame has two ring-shaped edge connectors that are open on the circumferential side and are arranged on axial outer edges of the filter screen, and two straight edge connectors arranged on circumferential-side ends of the filter screen between the ring-shaped edge connectors; and multiple support connectors arranged within the filter screen distributed on the circumferential side between the ring-shaped edge connectors.

3. The support element according to claim 2, wherein the straight edge connectors of the filter frame lie one above the other so as to be movable in a sliding motion on the circumferential side in an assembled state by an essentially flat radial outer recess on a radial inner one of the two straight edge connectors and also an essentially flat radial inner recess on the radial one of the two straight edge connectors.

4. The support element according to claim 3, wherein a total of the straight edge connectors effective as one common connector and the support connectors of the filter frame is an odd number if a number of relevant inlet openings in the cylindrical side wall of the piston is an even number.

5. The support element according to one of claim 2, wherein the ring-shaped edge connectors of the filter frame are provided with essentially identical radial outer recesses that are arranged diagonally opposite a circumferential partition gap of the ring filter.

6. The support element according to claim 2, further comprising multiple projections extending outward in a radial direction are arranged on an axially inner one of the ring-shaped edge connectors or on an axially outer one of the ring-shaped edge connectors of the filter frame distributed around a circumference, said projections contact an axially outer edge of an inner ring-shaped recess in the cylindrical side wall of the housing when the piston is moved outward in an axial direction.

7. The support element according to claim 6, wherein the projections that extend in the radial direction are constructed as circular segment-shaped bulges of the axially inner or axially outer one of the ring-shaped edge connectors arranged between the straight edge connectors and the support connectors of the filter frame.

8. The support element according to claim 6, wherein the radial projections are constructed as connector tabs formed integrally on the axially inner or axially outer one of the ring-shaped edge connectors axially adjacent to the outer straight edge connector or one of the support connectors of the filter frame.

9. The support element according to claim 2, wherein the filter screen and the filter frame of the ring filter are produced integrally as an injection molded part made from a plastic.

10. The support element according to claim 2, wherein the filter screen of the ring filter is made from a wire or fiber mesh, and the filter screen is injection molded with a plastic for forming the filter frame in an injection molding process.

11. A hydraulic support element for a variable valve train of an internal combustion engine, the hydraulic support element comprising:

a cylindrical pot-shaped housing having a cylindrical side wall and a base wall;

a hollow cylindrical piston guided for axial movement in said housing, the hollow cylindrical piston having a cylindrical side wall, an inner end and an outer end, the outer end extends past an outer edge of the housing and is constructed as a hemispherical bearing head;

an interior of the hollow cylindrical piston includes an inner supply pressure space and an outer switching pressure space that are connectable via respective inlet openings in the cylindrical side wall of the housing and the cylindrical side wall of the piston respectively with a supply pressure line and a cylinder head side switching pressure line, the piston has, in the cylindrical side wall in an area of the inlet openings leading into at least one of the supply pressure space or the switching pressure space, a ring-shaped recess radially on an outside thereof;

a compression spring biases the hollow cylindrical piston away from the base wall of the housing; and, a filter element constructed as a ring filter that is open on a circumferential side is inserted axially with a positive fit connection into the ring-shaped recess of the piston.

12. The support element according to claim 11, wherein the ring filter comprises:

a cylindrical filter screen that is open on a circumferential side; and, a filter frame surrounding the filter screen, the filter frame has at least one ring-shaped edge connector that is open on the circumferential side and are arranged on axial outer edges of the filter screen.

13. The support element according to claim 12, wherein the ring filter further comprises:

at least one straight edge connector arranged on circumferential-side ends of the filter screen.

14. The support element according to claim 13, wherein the ring filter further comprises:

at least one support connector arranged within the filter screen on the circumferential side.

15. The support element according to claim 14, wherein a total of the straight edge connectors effective as one common connector and the support connectors of the filter frame is an odd number if a number of relevant inlet openings in the cylindrical side wall of the piston is an even number.

16. The support element according to claim 14, further comprising multiple projections extending outward in a radial direction arranged on the at least one ring-shaped edge connector of the filter frame distributed around a circumference, said projections contact an axially outer edge of an inner ring-shaped recess in the cylindrical side wall of the housing when the piston is moved outward in an axial direction.

17. The support element according to claim 16, wherein the projections are constructed as circular segment-shaped bulges of the at least one ring-shaped edge connector arranged between the straight edge connectors and the support connectors of the filter frame.

18. The support element according to claim 16, wherein the radial projections are constructed as connector tabs formed integrally on the at least one ring-shaped edge connector.

* * * * *